US005704258A

United States Patent [19]

LaVoie

[11] Patent Number: 5,704,258

[45] Date of Patent: Jan. 6, 1998

[54] BOTTLE OPENING DEVICE

[76] Inventor: Homer P. LaVoie, 1555 Schuurman Rd., Castleton, N.Y. 12033

[21] Appl. No.: 628,238

[22] Filed: Apr. 4, 1996

[51] Int. Cl.[6] ..... B67B 7/14; B67B 7/18; B65B 43/40

[52] U.S. Cl. ..... 81/3.43; 53/381.4

[58] Field of Search ..... 53/381.4, 492, 53/390; 81/3.43, 3.31, 3.07

[56] References Cited

U.S. PATENT DOCUMENTS

| | | | |
|---|---|---|---|
| 2,718,800 | 9/1955 | Olson | 81/3.43 X |
| 2,771,802 | 11/1956 | Lewis | 81/3.43 |
| 2,793,550 | 5/1957 | Robinson et al. | 81/3.43 X |
| 2,937,548 | 5/1960 | McKim | 81/3.43 |
| 4,916,993 | 4/1990 | Siekawitch | 81/3.43 X |
| 5,329,831 | 7/1994 | Pierce, Jr. et al. | 81/3.43 |
| 5,522,284 | 6/1996 | Säde . | |

FOREIGN PATENT DOCUMENTS

| | | | |
|---|---|---|---|
| 466487 | 7/1950 | Canada | 81/3.43 |

*Primary Examiner*—Horace M. Culver
*Attorney, Agent, or Firm*—Sughrue,Mion,Zinn,Macpeak & Seas, PLLC

[57] ABSTRACT

A bottle opening device includes a flat base member which is adapted to be secured to a counter top or the like by suction cups on an under surface of the base member. A support member is secured to an upper surface of the base member and is provided with a horizontally disposed slot extending therethrough. An elongated strap is secured at one end to the support member adjacent the slot. The strap is adapted to extend about the periphery of the bottle and pass through the slot. Upon rotation of the lid and bottle in an opening direction, the bottle will clamp the strap between the bottle and the support member to immobilize the bottle so that upon continued application of turning force to the lid, the lid will be unscrewed from the bottle.

4 Claims, 1 Drawing Sheet

BOTTLE OPENING DEVICE

BACKGROUND OF THE INVENTION

The present invention is directed to a bottle opening device and more specifically to a strap secured to a support and extending about a bottle whereby upon rotation of the bottle and top in the opening direction, the strap will be tightly wrapped about the bottle and clamped between the bottle and the support to immobilize the bottle to allow the cap to be unscrewed.

It is old and well known in the art to secure one end of a strap to a vertical support mounted on a base member and wrapping the strap around a jar or bottle to be opened. The opposite end of the strap is secured to a device for applying a clamping force to the strap about the bottle to immobilize the bottle whereby upon subsequent turning of the lid, the bottle may be opened.

U.S. Pat. No. 152,940, U.S. Pat. No. 710,606 and U.S. Pat. No. 716,226 all disclose rigidly securing one end of a strap and securing the opposite end to a lever which may be operated to apply a clamping force to the strap about the bottle to immobilize the bottle. U.S. Pat. No. 1,292,933 is directed to a fruit jar holder having a strap which is rigidly secured at one end with the opposite end secured to a spindle whereby upon rotation of the spindle, a clamping force is applied to the strap about the jar to immobilize the jar. U.S. Pat. No. 2,047,477 is directed to a jar holder wherein the strap is rigidly secured at one end with the opposite end connected to a buckle whereby the strap may be adjustably tightened about the jar to immobilize the jar. In each of the prior art devices, it is necessary to manipulate the end of the strap in order to secure it to an adjustable clamping device and it is then necessary to apply a clamping force to the strap to tightly wrap the strap about the bottle or jar. Such manipulation and force application is difficult for people suffering from physical disabilities such as arthritis or the like.

SUMMARY OF THE INVENTION

The present invention provides a new and improved bottle opening device which does not require any manipulation of the free end of the strap to secure it to a force applying device or require any application of force to the strap since the strap is clamped about the jar or bottle simply by turning the lid on the jar or bottle in the opening direction.

The present invention provides a new and improved bottle opening device comprising a base member, an upstanding support secured to an upper surface of the base member with a horizontally disposed slot extending through the support member and a strap secured to the support member adjacent said slot and adapted to extend about the periphery of a bottle with the free end of the strap extending through the slot whereby upon turning of the lid and bottle in the opening direction of the lid, the strap will be clamped between the bottle and the support member to immobilize the bottle so that continued application of force to the lid will turn the lid in the opening direction to open the bottle.

The above and other objects, features and advantages of the present invention will be more apparent and more readily appreciated from the following detailed description of a preferred exemplary embodiment of the present invention, taken in connection with the accompanying drawings.

DETAILED DESCRIPTION OF THE INVENTION

The bottle opening device according to the present invention is comprised of a flat base member 10 having a plurality of suction cups 12 secured to the bottom surface thereof for engaging a counter top or table top and holding the device in the desired position during a bottle opening operation. The number and distribution of suction cup devices may vary as long sufficient holding power is provided. Other suitable holding devices or anti-skid devices may also be provided in lieu of suction cups.

Figure 2:
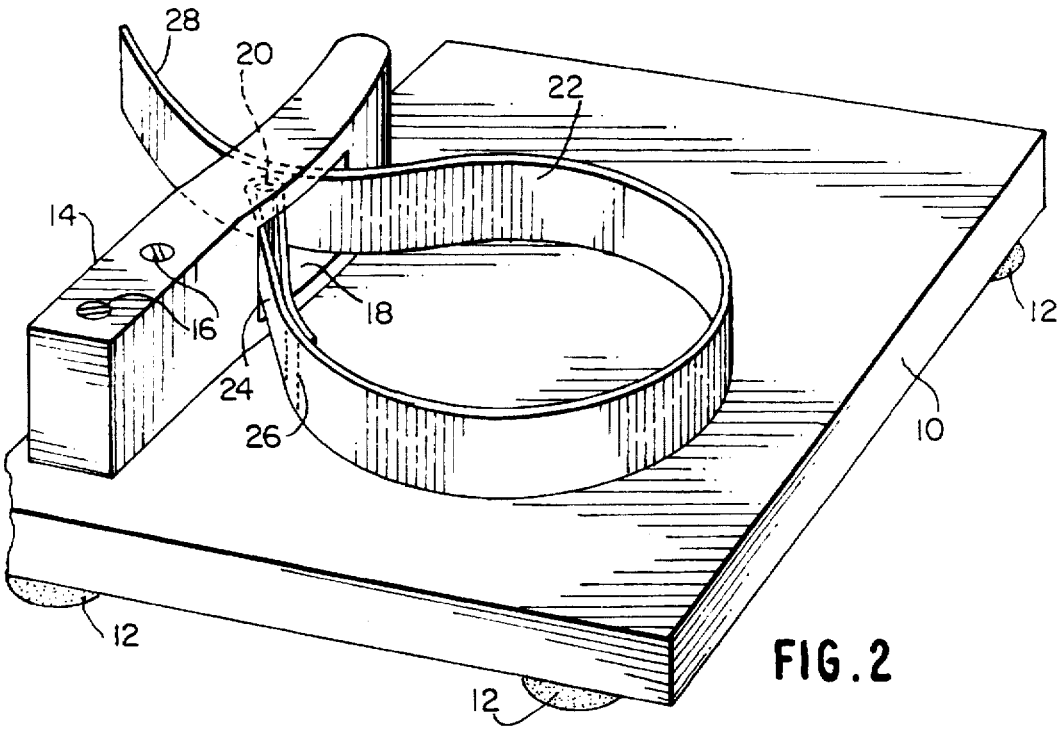
FIG. 2 is a perspective view of the bottle opening device without the bottle.

An upstanding support member 14 is secured to the upper surface of the base member 10 adjacent one side thereof. The support member 14 may be secured to the base member by screws 16 or any other suitable means such as an adhesive or the like. The support member 14 has a substantially elongated configuration with a horizontally disposed slot 18 extending therethrough. A vertically disposed pin 20 is secured in the slot 18 adjacent one side thereof. An elongated strap 22 is provided with a loop 24 at one end through which the pin 20 extends. The loop may be formed by bending back the end of the strap and securing it to the main body of the strap by means of stitches 26 as shown in FIG. 2.

If the loop is permanent, as is the case with stitches, the pin 20 should be removably mounted in the opening. Accordingly, the pin could be a telescopic spring biased pin such as the type conventionally used to support toilet paper rolls. Alternatively, the reversely bent strap end could be secured to the body of the strap by means of VELCRO, snaps or any other detachable fastener means to allow the strap to be detachably connected to the pin 20. The strap 22 extends in a large loop on the upper surface of the base member 10 as shown in FIGS. 1 and 2 with the free end 28 of the strap extending through the slot 18.

Figure 1:
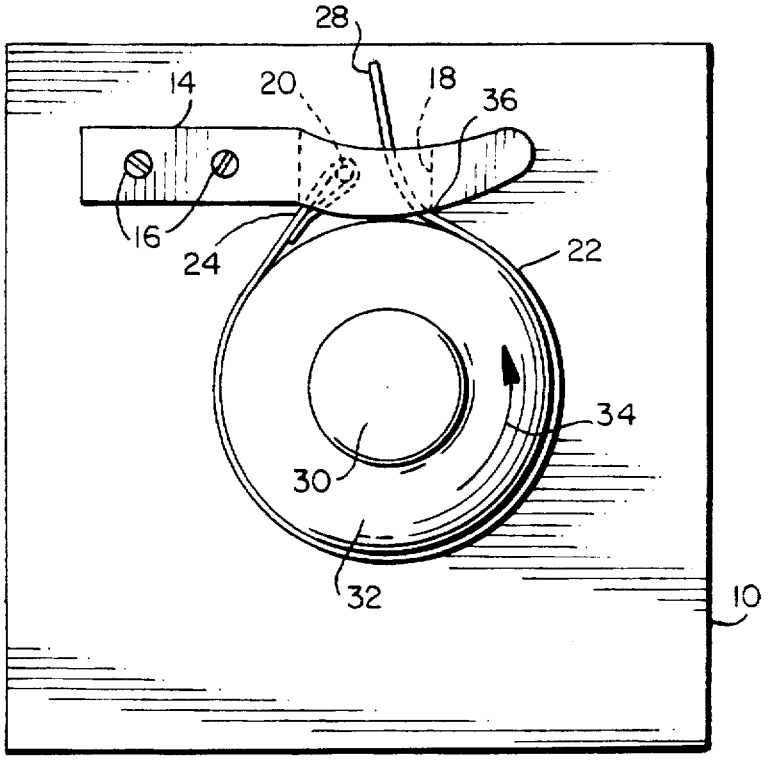
FIG. 1 is a top plan view of the bottle opening device in conjunction with a bottle.

When it is desired to remove the lid 30 from a jar or bottle 32, it is only necessary to place the jar or bottle 32 in the looped strap 22 as shown in FIG. 1 and pull the free end 28 of the strap 22 to take up the slack in the strap. It is not necessary to apply a force to the strap 22 sufficient to immobilize the jar or bottle 32. In order to open the bottle 32, the lid 30 is rotated in the direction of the arrow 34 which is the conventional opening direction for a screw threaded lid. Initially, the lid 30 and the jar 32 will rotate simultaneously in the direction of the arrow until the jar or bottle presses the strap 22 against the upright support 14 at point 36. Continued rotation of the lid and bottle will cause the bottle 32 to roll slightly about the point 36 until the strap 22 firmly grips the bottle 32 to prevent further rotation thereof. At this point, the entire turning force will be applied to the lid 30 to unscrew the lid from the bottle.

The foregoing operation is extremely simple and does not require any undue manipulation of the free end 28 of the strap 22 or the application of any undue force to the free end 28 of the strap 22. Thus a person only having the use of one arm could readily place the jar on the support base, pass the strap about the jar with the free end extending through the slot 18 and applying a turning force to the lid 30.

The strap 22 may be of any suitable material to apply the desired gripping force to the jar or bottle. The strap may be made of leather, nylon or any other suitable material provided with a rubberized coating or the like. The strap is preferably 1½ to 1¾ inches wide and approximately 24 inches long. Such a strap would be suitable for handling jars and bottles of any size, from baby food jars to gallon size juice containers.

While the invention has been particularly shown and described with reference to preferred embodiments thereof, it will be understood by those in the art that the foregoing and other changes in form and details may be made therein without departing from the spirit and scope of the invention.

What is claimed is:

1. A bottle opening device comprising a base member, a support member fixedly secured to an upper surface of said base member with a horizontally disposed slot extending through said support member, an elongated strap secured at one end to said support member adjacent said slot and adapted to extend about a periphery of a bottle resting on said base member with a free opposite end of said strap extending through said slot whereby upon pulling the free end of the strap to engage the strap with the bottle and turning a lid on the bottle in an opening direction of the lid, the strap will be clamped between the bottle and the support member to immobilize the bottle so that continued application of force to the lid will turn the lid in the opening direction to open the bottle.

2. A bottle opening device as set forth in claim 1, wherein said base member is provided with restraining means secured thereto for holding said bottle opening device in position on a support surface.

3. A bottle opening device as set forth in claim 2, wherein said restraining means is comprised of a plurality of suction devices mounted on an under surface of said base member.

4. A bottle opening device as set forth in claim 1, further comprising pin means vertically mounted in said slot to which said one end of said strap is secured.

* * * * *